US011287202B2

(12) United States Patent
Werner et al.

(10) Patent No.: US 11,287,202 B2
(45) Date of Patent: Mar. 29, 2022

(54) MAGAZINE DEVICE FOR FIREARMS WITH OPTIMIZED USE OF SPACE

(71) Applicant: Carl Walther GmbH, Ulm (DE)

(72) Inventors: Martin Werner, Langenau (DE); Eyck Pflaumer, Arnsberg (DE); Martin Wonisch, Arnsberg (DE)

(73) Assignee: Carl Walther GmbH, Ulm (DE)

( * ) Notice: Subject to any disclaimer, the term of this patent is extended or adjusted under 35 U.S.C. 154(b) by 0 days.

(21) Appl. No.: 17/159,450

(22) Filed: Jan. 27, 2021

(65) Prior Publication Data

US 2021/0364242 A1 Nov. 25, 2021

(30) Foreign Application Priority Data

May 19, 2020 (DE) ..... 10 2020 113 534.3

(51) Int. Cl.
*F41A 9/69* (2006.01)
*F41A 9/70* (2006.01)

(52) U.S. Cl.
CPC . *F41A 9/69* (2013.01); *F41A 9/70* (2013.01)

(58) Field of Classification Search
CPC ..... F41A 9/69; F41A 9/70; F41A 9/71; F41A 9/64; F41A 9/66; F41A 9/67
USPC ..... 42/49.01, 18, 22, 50
See application file for complete search history.

(56) References Cited

U.S. PATENT DOCUMENTS 3,732,643 A * 5/1973 Wells ..... F41A 9/69 42/50
3,736,686 A * 6/1973 Moller ..... F41A 9/67 42/6
4,472,900 A * 9/1984 Howard ..... F41A 9/69 42/50
4,580,364 A * 4/1986 Vyprachticky ..... F41A 9/65 42/50
4,658,700 A * 4/1987 Sullivan ..... F41A 9/37 89/33.02
4,765,081 A * 8/1988 Dieringer ..... F41A 9/65 42/50
4,768,301 A * 9/1988 Thomas ..... F41A 17/38 42/7

(Continued)

FOREIGN PATENT DOCUMENTS

DE 102017120147 A1 3/2019

OTHER PUBLICATIONS

German Office Action dated Jan. 22, 2021 for German Patent Application No. 102020113534.3.

(Continued)

*Primary Examiner* — Michael D David
(74) *Attorney, Agent, or Firm* — Bachman & LaPointe, P.C.

(57) ABSTRACT

A magazine device (100) for a double-row arrangement of successive cartridges (200) be inserted into a barrel of a firearm. A magazine housing (110) has an opening (150) to be placed below the cartridge chamber when inserted into the firearm for successive delivery of each cartridge (200). Two of the four opposite walls (112, 114) of the magazine housing (110) in a transition region below the opening (150) form a feed section (160) for successively feeding each cartridge (200) into the opening (150). The feed section (160) formed in the transition stage by two opposite walls (112, 114) of the magazine housing (110) is of a curved form.

16 Claims, 2 Drawing Sheets

(56) References Cited

U.S. PATENT DOCUMENTS

| | | | | |
|---|---|---|---|---|
| 4,833,969 | A * | 5/1989 | Winkler | F41A 9/22 89/36.13 |
| 4,862,620 | A | 9/1989 | Chesnut et al. | |
| 5,153,359 | A * | 10/1992 | Lishness | F41A 9/70 42/50 |
| 5,386,657 | A | 2/1995 | Racheli | |
| 9,651,324 | B2 * | 5/2017 | Hayes | F41A 9/69 |
| 10,215,515 | B1 * | 2/2019 | Kruse | F41A 9/69 |
| 2012/0066950 | A1 * | 3/2012 | Davidson | F41A 9/69 42/50 |
| 2012/0167428 | A1 | 7/2012 | Watermann et al. | |
| 2015/0075050 | A1 * | 3/2015 | Hayes | F41A 9/69 42/50 |
| 2019/0033023 | A1 * | 1/2019 | Shipley | F41A 15/00 |
| 2019/0072348 | A1 | 3/2019 | Samsel | |
| 2020/0011623 | A1 | 1/2020 | Kramer | |
| 2020/0096272 | A1 | 3/2020 | Brown et al. | |
| 2020/0278163 | A1 * | 9/2020 | Davidson | F41A 9/70 |

OTHER PUBLICATIONS

"Krümmungsradius", Höhere Mathematik 2: Analysis und Gewöhnliche Differentialgleich, ingenieurkurse.de—examio GmbH, Siegen, Germany retrieved from internet Jan. 22, 2021 https://www.ingenieurkurse.de/hoehere-mathematik-analysis-gewoehnlichedifferentialgleichungen/kurveneigenschaften-im-ebenenraum/kruemmung/kruemmungsradius.html.

* cited by examiner

MAGAZINE DEVICE FOR FIREARMS WITH OPTIMIZED USE OF SPACE

CROSS-REFERENCE TO RELATED APPLICATION

Priority is claimed of German Patent Application No. DE102020113534.3, filed May 19, 2020, and entitled "Magazine Device for Firearms with Optimized Use of Space", the disclosure of which is incorporated by reference herein in its entirety as if set forth at length.

BACKGROUND

The invention relates to a magazine device for a double-row arrangement of cartridges that can be successively inserted into a cartridge chamber of a barrel of a firearm, with a magazine housing with a magazine spring mounted therein, one end of which is supported against a cartridge feeder for conveying cartridges into the cartridge chamber of the firearm and the other end of which is at least indirectly supported against a magazine floor, wherein in its section remote from the magazine floor the magazine housing has an opening that comes to lie below the cartridge chamber when inserted in the firearm for successive output of each cartridge, and wherein in a transition area below the opening two of four opposite walls of the magazine housing form a feed section for feeding successive cartridges into the opening.

Magazine devices of the type mentioned above have long been known in the prior art as a hollow storage body and as a feeding device of cartridges into a cartridge chamber of a firearm. The well-known double-row magazine devices have the advantage of an increased cartridge capacity compared to single-row magazine devices, wherein the central longitudinal axes of the cartridges of a first row of stacked cartridges are shifted by a predetermined amount compared to the central longitudinal axes of a second row of stacked cartridges for the purpose of an advantageous use of space within a magazine housing.

The feed section for successively feeding each cartridge into the opening of a magazine housing is regularly of a straight linear form in magazine devices with a double-row cartridge arrangement. This has the disadvantage that the cartridge capacity in a double-row magazine device is not yet optimized according to the current state of the art.

SUMMARY

The object of the invention is therefore to create a double-row magazine device whose cartridge capacity is improved compared to the known magazine devices in the prior art.

For a magazine device of the aforementioned type, this object is achieved according to the invention in that the feed section formed in the transition region of two opposite walls of the magazine housing is curved.

Preferred embodiments of the invention are the subject matter of the subordinate claims, the elements of which act in the sense of a further improvement of the approach to achieving the object underlying the invention.

In the magazine device according to the invention, improved space utilization is achieved within a magazine housing compared to the prior art with the aid of the combination of features whereby the feed section formed in the transition region of two opposite walls of the magazine housing is of a curved form, with the consequence that compared to conventional magazine devices of the same length the cartridge capacity is increased by one to three cartridges, as a rule by two cartridges.

According to a first preferred embodiment of the magazine device according to the invention, it is provided that starting from a lower magazine section, in which the opposite walls of the magazine housing are aligned parallel to each other, the radius of curvature of the feed section increases towards the opening of the feed section.

According to another definition of a preferred embodiment of the magazine device according to the invention, a respective lower cartridge within the feed section is adjacent to a respective upper cartridge so as to press the respective upper cartridge against a respective adjacent feed section at a predetermined friction angle.

The radius of curvature of the feed section is measured from the lower magazine section, in which the respective two walls of the magazine housing are aligned parallel to each other, towards the opening of the feed section, in order to bring the contact point of a cartridge within the curved section of the magazine housing into a predetermined constant friction angle with the adjacent feed section independently of position.

Furthermore, the radius of curvature of the feed section is dimensioned from the lower section of the magazine, in which the respective two walls of the magazine housing are aligned parallel to each other, to the opening of the feed section in order to position a lower cartridge with respect to an upper cartridge directly above it within the curved section of the magazine housing in such a way that an extension of a straight line connecting the center of the lower cartridge to the center of the cartridge arranged directly above it and an extension of a straight line connecting the center of the upper cartridge to the contact point of the upper cartridge with the relevant adjacent feed section are arranged at a predefined friction angle to each other.

The friction angle is defined as the angle at which, starting from a line connecting the center of a cartridge to the contact point of a respective adjacent feed section, the friction between an upper cartridge and the adjacent feed section is smaller than the force action exerted by a lower cartridge on an upper cartridge, so that the respective upper cartridge is reliably shifted along the feed section at the friction angle in the case of a predetermined pressure exertion effect caused by a magazine spring.

The friction angle is preferably dimensioned between 25° and 40° and in particular at about 30°.

BRIEF DESCRIPTION OF THE DRAWINGS

The magazine device according to the invention is explained below on the basis of a preferred embodiment, which is represented in the figures of the drawing. In the figures.

DETAILED DESCRIPTION

Figure 1:
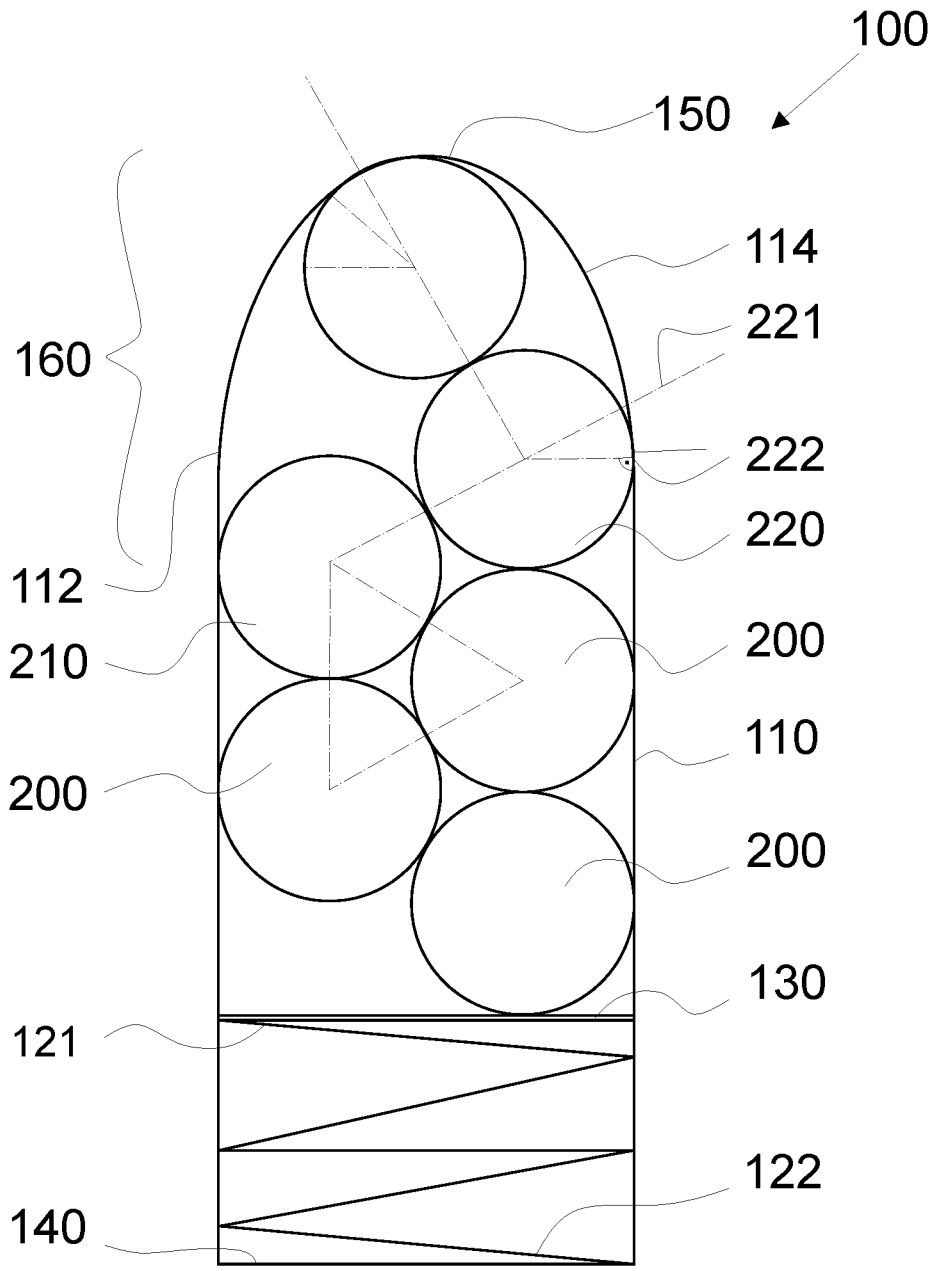
FIG. 1 shows a preferred embodiment of the magazine device according to the invention in a longitudinal section.

The magazine device 100 according to the invention shown in FIG. 1 has a double-row arrangement of cartridges 200 that can be successively inserted into a cartridge chamber of a barrel of a firearm and contains a magazine housing 110 with a magazine spring 120 mounted therein, one end 121 of which is supported against a cartridge feeder 130 for conveying cartridges 200 into the cartridge chamber of the firearm and the other end 122 of which is supported against a magazine floor 140.

In its section 140 remote from the magazine floor, the magazine housing 110 has an opening 150 to be located, when inserted in a firearm, below the cartridge chamber for successive delivery of each cartridge 200, wherein two of four opposing walls 112, 114 of the magazine housing 110 in a transition area below the opening 150 form a feed section 160 for successively feeding each cartridge 200 into the opening 150.

The feed section 160 formed in the transition region of the two opposite walls 112, 114 of the magazine housing 110 is of a curved form, wherein the radius of curvature of the feed section 160 increases from a lower section of the magazine, in which the opposite walls 112, 114 of the magazine housing 110 are aligned parallel to each other, to the opening 150 of the feed section 160.

A respective lower cartridge 210 is adjacent to a respective upper cartridge 220 within the feed section 160 in order to press the respective upper cartridge 220 against a respective adjacent feed section 160 at a predetermined friction angle.

The radius of curvature of the feed section 160 is dimensioned starting from the lower part of the magazine, in which the respective two walls 112, 114 of the magazine housing 110 are aligned parallel to each other, to the opening 150 of the feed section 160 to bring the contact point 222 of a cartridge 200 within the curved section of the magazine housing 110 to a predetermined constant friction angle with the adjacent feed section 160 independently of position.

The radius of curvature of the feed section 160 is dimensioned from the lower magazine section, in which the respective two walls 112, 114 of the magazine housing 110 are aligned parallel to each other, to the opening 150 of the feed section 160 so as to position a respective lower cartridge 210 relative to a respective upper cartridge 220 directly above it within the curved section of the magazine housing 110 in such a way that an extension of the straight line 221 connecting the center of the lower cartridge 210 to the center of the cartridge 200 arranged directly above it and an extension of a straight line 221 connecting the center line of the upper cartridge 220 to the contact point 222 of the upper cartridge 220 with the corresponding adjacent feed section 160 are arranged at the predetermined friction angle relative to each other.

The friction angle is defined as the angle at which, starting from a line connecting the center of a cartridge 200 to the contact point 222 of an adjacent respective feed section 160, the friction between an upper cartridge 220 and the adjacent feed section 160 is less than the force action exerted by a lower cartridge 210 on a respective upper cartridge 220, so that the respective upper cartridge 220 is reliably movable along the feed section 160 at the friction angle in the event of a predetermined pressure caused by a magazine spring 120.

In the case of the above exemplary embodiment, the friction angle is dimensioned at about 30°.

The exemplary embodiment of the invention explained above serves only the purpose of a better understanding of the teaching according to the invention prescribed by the claims, which as such is not restricted by the exemplary embodiment.

Figure 2:
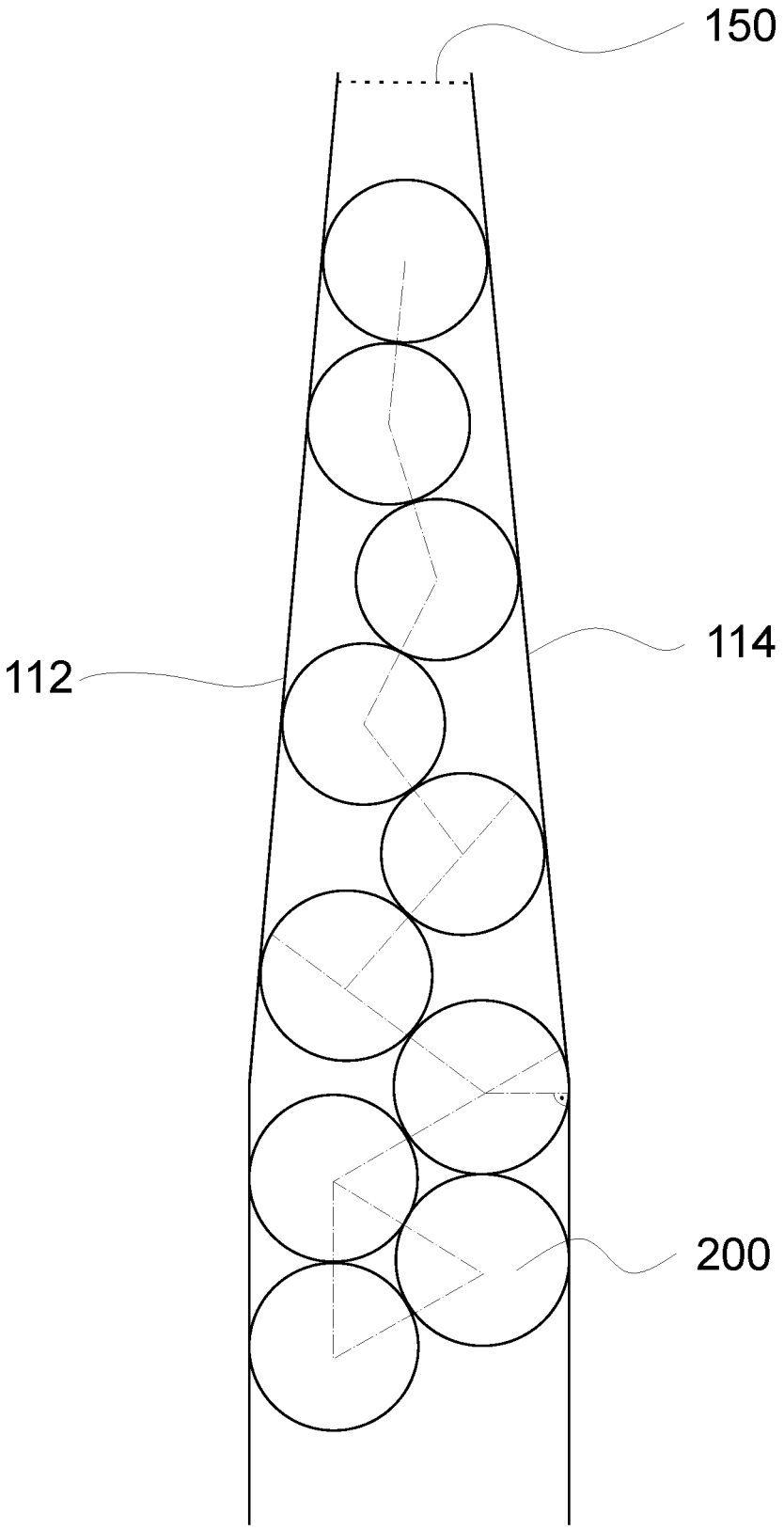
FIG. 2 shows an embodiment of a magazine device according to the prior art in a longitudinal section.

In contrast to the embodiment according to the invention of a magazine device 100 represented in FIG. 1, FIG. 2 shows a magazine device 100 according to the prior art, in which the stage is not bent but is guided in a straight line.

LIST OF REFERENCE SIGNS

Below is a list of reference signs used in the drawings:

100 Magazine Device
110 Magazine housing
112, 114 Walls of the magazine housing
120 Magazine spring
121 First end of the magazine spring
122 Second end of the magazine spring
130 Cartridge feeder
140 Magazine floor
150 Opening
160 Feed section
200 Cartridge
210 Lower cartridge
220 Upper cartridge
221 Straight line
222 Point of contact

What is claimed is:

1. A magazine device (100) configured for a double-row arrangement of cartridges (200) that can be successively inserted into a cartridge chamber of a barrel of a firearm, with a magazine housing (110) with a magazine spring (120), one end (121) of which is supported against a cartridge feeder (130) for conveying cartridges (200) into the cartridge chamber of the firearm and the other end (122) of which is at least indirectly supported against a magazine floor (140), wherein in its section remote from the magazine floor (140) the magazine housing (110) has an opening (150) to be located below the cartridge chamber when inserted in a firearm for successive delivery of each cartridge (200), and wherein two walls (112, 114) of four opposite walls (112, 114) of the magazine housing (110) form a feed section (160) in a transition region below the opening (150) for successively feeding a respective cartridge (200) into the opening (150), wherein the feed section (160) formed in the transition region of two opposite walls (112, 114) of the magazine housing (110) is of a curved form.

2. The magazine device (100) according to claim 1, wherein the radius of curvature of the feed section (160) increases starting from a lower magazine section, in which the opposite walls (112, 114) of the magazine housing (110) are aligned parallel to each other, to the opening (150) of the feed section (160).

3. The magazine device (100) according to claim 2, wherein a respective lower cartridge (210) within the feed section (160) is adjacent to a respective upper cartridge (220) in order to press the respective upper cartridge (220) against a respective adjacent feed section (160) at a predetermined friction angle.

4. The magazine device (100) according to claim 3, wherein the radius of curvature of the feed section (160), starting from the lower part of the magazine in which the two walls in question (112, 114) of the magazine housing (110) are aligned parallel to each other, to the opening (150) of the feed section (160), is dimensioned to bring the contact point (222) of a cartridge (200) within the curved section of the magazine housing (110) into a predetermined constant friction angle with the adjacent feed section (160) independently of position.

5. The magazine device (100) according to claim 4, wherein the radius of curvature of the feed section (160), starting from the lower magazine section, in which the respective two walls (112, 114) of the magazine housing (110) are aligned parallel to each other, to the opening (150) of the feed section (160), is dimensioned so as to position a respective lower cartridge (210) with respect to a respective upper cartridge (220) arranged directly above it within the curved section of the magazine housing (110) in such a way that an extension of a straight line (211) connecting the center of the lower cartridge (210) to the center of the upper cartridge (220) directly above it and an extension of a straight line (221) connecting the center of the upper cartridge (220) to the contact point (222) of the upper cartridge (220) with the corresponding adjacent feed section (160) are arranged at the predetermined friction angle relative to each other.

6. The magazine device (100) according to claim 5, wherein the friction angle is defined as the angle at which, starting from a line which connects the centre of a cartridge (200) to the contact point (222) of a respective adjacent feed section (160), the friction between a respective upper cartridge (220) and the adjacent feed section (160) is less than that of a force action exerted by a lower cartridge (210) on a respective upper cartridge (220), so that the respective upper cartridge (220) is reliably movable along the feed section (160) at the friction angle by a predetermined pressure exerted by a magazine spring (120).

7. The magazine device (100) according to claim 6, wherein the friction angle is dimensioned at between 25° and 40°.

8. The magazine device (100) according to claim 7, wherein the friction angle is dimensioned at about 30°.

9. The magazine device (100) according to claim 1, wherein a respective lower cartridge (210) within the feed section (160) is adjacent to a respective upper cartridge (220) in order to press the respective upper cartridge (220) against a respective adjacent feed section (160) at a predetermined friction angle.

10. The magazine device (100) according to claim 1, wherein the radius of curvature of the feed section (160), starting from the lower part of the magazine in which the two walls in question (112, 114) of the magazine housing (110) are aligned parallel to each other, to the opening (150) of the feed section (160), is dimensioned to bring the contact point (222) of a cartridge (200) within the curved section of the magazine housing (110) into a predetermined constant friction angle with the adjacent feed section (160) independently of position.

11. The magazine device (100) according to claim 1, wherein the radius of curvature of the feed section (160), starting from the lower magazine section, in which the respective two walls (112, 114) of the magazine housing (110) are aligned parallel to each other, to the opening (150) of the feed section (160), is dimensioned so as to position a respective lower cartridge (210) with respect to a respective upper cartridge (220) arranged directly above it within the curved section of the magazine housing (110) in such a way that an extension of a straight line (211) connecting the center of the lower cartridge (210) to the center of the upper cartridge (220) directly above it and an extension of a straight line (221) connecting the center of the upper cartridge (220) to the contact point (222) of the upper cartridge (220) with the corresponding adjacent feed section (160) are arranged at the predetermined friction angle relative to each other.

12. The magazine device (100) according to claim 11, wherein the friction angle is defined as the angle at which, starting from a line which connects the centre of a cartridge (200) to the contact point (222) of a respective adjacent feed section (160), the friction between a respective upper cartridge (220) and the adjacent feed section (160) is less than that of a force action exerted by a lower cartridge (210) on a respective upper cartridge (220), so that the respective upper cartridge (220) is reliably movable along the feed section (160) at the friction angle by a predetermined pressure exerted by a magazine spring (120).

13. The magazine device (100) according to claim 1, wherein the friction angle is dimensioned at between 25° and 40°.

14. The magazine device (100) according to claim 1, wherein the friction angle is dimensioned at about 30°.

15. A combination of the magazine device (100) of claim 1 and the double-row arrangement of cartridges (200) wherein the magazine spring (120) biases the cartridge feeder (130) against the double-row arrangement of cartridges (200).

16. A method for using the magazine device (100) of claim 1, the method comprising:

the magazine spring (120) biasing the cartridge feeder (130) against the double-row arrangement of cartridges (200); and successively feeding a respective cartridge (200) into the opening (150).

* * * * *